US009551961B2

(12) United States Patent
Hayase et al.

(10) Patent No.: US 9,551,961 B2
(45) Date of Patent: Jan. 24, 2017

(54) FIXING DEVICE HAVING HEATING SECTION SUPPORT WITH HOLE FOR RELEASING HEAT

(71) Applicant: Konica Minolta, Inc., Chiyoda-ku, Tokyo (JP)

(72) Inventors: Toru Hayase, Toyohashi (JP); Koji Yamamoto, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/983,965

(22) Filed: Dec. 30, 2015

(65) Prior Publication Data

US 2016/0195841 A1 Jul. 7, 2016

(30) Foreign Application Priority Data

Jan. 5, 2015 (JP) ..... 2015-000308

(51) Int. Cl.
*G03G 15/20* (2006.01)
*G03G 21/16* (2006.01)

(52) U.S. Cl.
CPC ..... *G03G 15/2053* (2013.01); *G03G 15/2017* (2013.01); *G03G 21/1685* (2013.01);
(Continued)

(58) Field of Classification Search
CPC ..... G03G 15/2017; G03G 15/2053; G03G 21/1685; G03G 2215/2016; G03G 2215/2019; G03G 2215/2038; G03G 2221/1639
(Continued)

(56) References Cited

U.S. PATENT DOCUMENTS 6,088,558 A * 7/2000 Yamada ..... G03G 15/0131 198/806
6,580,894 B1 * 6/2003 Kobashigawa .... G03G 15/2064 219/216
(Continued)

FOREIGN PATENT DOCUMENTS

JP 2002-251091 A 9/2006
JP 2012-103372 A 5/2012
(Continued)

*Primary Examiner* — Robert Beatty
(74) *Attorney, Agent, or Firm* — Buchanan Ingersoll & Rooney PC

(57) ABSTRACT

A fixing device having: a fixing member extending in a first predetermined direction; a heating roller extending in the first predetermined direction; a fixing belt stretched between the fixing member and the heating roller and being annular when viewed in a plan view in the first predetermined direction; a heating section heating the heating roller and being provided in the heating roller; a first support section supporting the heating roller in such a manner that the heating roller is movable with respect to the fixing member along a predetermined plane perpendicular to the first predetermined direction; a pressure section exerting a force upon the heating roller in such a direction that the heating roller moves away from the fixing member; and a second support section supporting the heating section in such a manner that the heating section is movable together with the heating roller.

6 Claims, 9 Drawing Sheets

(52) U.S. Cl.
CPC ..... *G03G 2215/2019* (2013.01); *G03G 2215/2038* (2013.01); *G03G 2221/1639* (2013.01)

(58) Field of Classification Search
USPC ..... 399/122, 328, 329; 219/216
See application file for complete search history.

(56) References Cited

U.S. PATENT DOCUMENTS

| | | | | |
|---|---|---|---|---|
| 6,865,364 | B2 * | 3/2005 | Matsumoto | G03G 15/2032 219/216 |
| 8,750,756 | B2 * | 6/2014 | Tanda | G03G 15/2032 399/122 |
| 2008/0003029 | A1 * | 1/2008 | Fujimori | G03G 15/2053 399/329 |
| 2008/0310866 | A1 * | 12/2008 | Kim | G03G 15/2064 399/33 |
| 2011/0135341 | A1 * | 6/2011 | Kamiya | G03G 21/1685 399/122 |
| 2016/0098000 | A1 * | 4/2016 | Furuichi | G03G 15/2053 399/69 |

FOREIGN PATENT DOCUMENTS

| | | | |
|---|---|---|---|
| JP | 2013-003190 | A | 1/2013 |
| JP | 2014-048612 | A | 3/2014 |
| JP | 2014-056147 | A | 3/2014 |

* cited by examiner

44

FIXING DEVICE HAVING HEATING SECTION SUPPORT WITH HOLE FOR RELEASING HEAT

This application is based on Japanese Patent Application No. 2015-308 filed on Jan. 5, 2015, the content of which is incorporated herein by reference.

BACKGROUND OF THE INVENTION

1. Field of the Invention

The present invention relates to fixing devices, particularly to a fixing device in which a heating section is provided in a heating roller.

2. Description of Related Art

As an invention relevant to a conventional fixing device, for example, a fixing device described in Japanese Laid-Open Patent Publication No. 2013-3190 is known. This fixing device includes a heating roller, a fixing roller, a heater, and a fixing belt. The heating roller and the fixing roller are arranged parallel to each other. The fixing belt is stretched between the heating roller and the fixing roller. The heater is provided in the heating roller so as to heat the heating roller.

To put the fixing belt and the heating roller in tight contact, the fixing device as above has a structure to be descried below. The heating roller is configured so as to be slidable with respect to the fixing roller in a direction perpendicular to an axial direction of the heating roller. Further, the heating roller receives a force from an elastic object, such as a spring, in a direction away from the fixing roller. This puts the fixing belt in tight contact with the heating roller without slackening. As a result, heat from the heating roller is efficiently transferred to the fixing belt.

Incidentally, as for the above fixing device, there is difficulty in reducing the diameter of the heating roller. More specifically, the fixing device is configured in such a manner as to allow the heating roller to slide with respect to the fixing roller. However, the heating roller has the heater provided therein, and the heater is not slidable with respect to the fixing roller. Accordingly, if the diameter of the heating roller is reduced excessively, the heater might hit the inner circumferential surface of the heating roller when the heating roller slides.

SUMMARY OF THE INVENTION

A fixing device according to an embodiment of the present invention includes: a fixing member extending in a first predetermined direction; a heating roller extending in the first predetermined direction; a fixing belt stretched between the fixing member and the heating roller and being annular when viewed in a plan view in the first predetermined direction; a heating section heating the heating roller and being provided in the heating roller; a first support section supporting the heating roller in such a manner that the heating roller is movable with respect to the fixing member along a predetermined plane perpendicular to the first predetermined direction; a pressure section exerting a force upon the heating roller in such a direction that the heating roller moves away from the fixing member; and a second support section supporting the heating section in such a manner that the heating section is movable together with the heating roller.

DETAILED DESCRIPTION OF THE PREFERRED EMBODIMENTS

Configuration of Image Forming Apparatus

Figure 1:
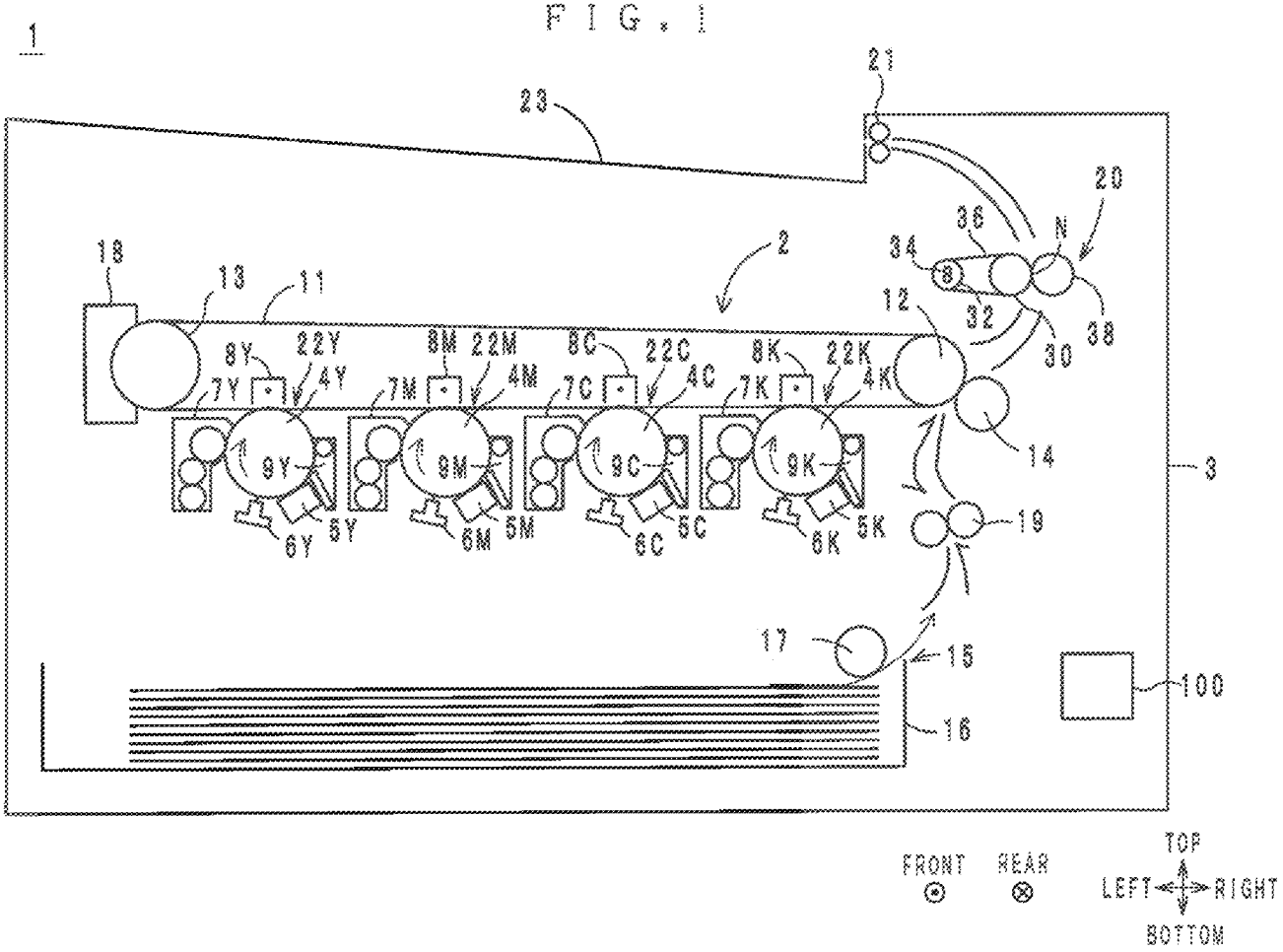
FIG. 1 is a diagram illustrating the overall configuration of an image forming apparatus 1.

Hereinafter, an image forming apparatus including a fixing device according to an embodiment of the present invention will be described with reference to the drawings. FIG. 1 is a diagram illustrating the overall configuration of the image forming apparatus 1. The right-left, front-back, and top-bottom directions of the sheet of FIG. 1 will be simply referred to below as the right-left, front-back, and top-bottom directions.

The image forming apparatus 1 is an electrophotographic color printer of a so-called tandem type adapted to combine images in four colors (Y: yellow, M: magenta, C: cyan, and K: black). The image forming apparatus 1 has the function of forming an image on a sheet (printing medium) on the basis of image data obtained by a scanner, and includes a printing unit 2, a main body 3, a paper feed cassette 15, a timing roller pair 19, a fixing device 20, an ejection roller pair 21, an output tray 23, and a control unit 100, as shown in FIG. 1.

The main body 3 is a housing for the image forming apparatus 1, and accommodates the printing unit 2, the paper feed cassette 15, the timing roller pair 19, the fixing device 20, the ejection roller pair 21, and the control unit 100.

The paper feed cassette 15*a* plays the role of supplying sheets one by one, and generally includes a sheet tray 16 and a paper feed roller 17. In the sheet tray 16, a plurality of unprinted sheets are stacked and mounted. The paper feed roller 17 takes out the sheets mounted in the sheet tray 16 one by one.

The timing roller pair 19 forwards a sheet having been supplied by the paper feed cassette 15 while performing timing control such that the sheet is subjected to secondary transfer of toner images in the printing unit 2.

The printing unit 2 is adapted to form toner images on the sheet having been supplied by the paper feed cassette 15, and includes imaging units 22Y, 22M, 22C, and 22K, transfer units 8Y, 8M, 8C, and 8K, an intermediate transfer belt 11, a drive roller 12, a driven roller 13, a secondary transfer roller 14, and a cleaning device 18. Moreover, the imaging units 22Y, 22M, 22C, and 22K respectively include photoreceptor drums 4Y, 4M, 4C, and 4K, chargers 5Y, 5M, 5C, and 5K, optical scanning devices 6Y, 6M, 6C, and 6K, developing devices 7Y, 7M, 7C, and 7K, and cleaners 9Y, 9M, 9C, and 9K.

The photoreceptor drums 4Y, 4M, 4C, and 4K are provided in the form of cylinders in the main body 3. The photoreceptor drums 4Y, 4M, 4C, and 4K are rotated clockwise in FIG. 1. The chargers 5Y, 5M, 5C, and 5K electrically charge the circumferential surfaces of the photoreceptor drums 4Y, 4M, 4C, and 4K. The optical scanning devices 6Y, 6M, 6C, and 6K under control of the control unit 100 scan beams BY, BM, BC, and BK (not shown) on the circumferential surfaces of the photoreceptor drums 4Y, 4M, 4C, and 4K. As a result, electrostatic latent images are formed on the circumferential surfaces of the photoreceptor drums 4Y, 4M, 4C, and 4K.

The developing devices 7Y, 7M, 7C, and 7K are provided in the main body 3 in order to apply toner to the photoreceptor drums 4Y, 4M, 4C, and 4K and thereby develop toner images based on the electrostatic latent images.

The intermediate transfer belt 11 is stretched between the drive roller 12 and the driven roller 13. The intermediate transfer belt 11 is subjected to primary transfer of the toner images developed on the photoreceptor drums 4Y, 4M, 4C, and 4K. The transfer units 8Y, 8M, 8C, and 8K are disposed so as to face the inner circumferential surface of the intermediate transfer belt 11, and play the role of subjecting the intermediate transfer belt 11 to primary transfer of toner images formed on the photoreceptor drums 4Y, 4M, 4C, and 4K. The cleaners 9Y, 9M, 9C, and 9K collect toner remaining on the circumferential surfaces of the photoreceptor drums 4Y, 4M, 4C, and 4K after primary transfer. The drive roller 12 is caused to rotate by an intermediate transfer belt drive unit (not shown in FIG. 1), thereby driving the intermediate transfer belt 11 counterclockwise. As a result, the intermediate transfer belt 11 carries the toner images to the secondary transfer roller 14.

The secondary transfer roller 14 is in the form of a drum facing the intermediate transfer belt 11. Upon application of a voltage for transfer, the secondary transfer roller 14 subjects a sheet passing between the intermediate transfer belt 11 and the secondary transfer roller 14 to secondary transfer of the toner images carried on the intermediate transfer belt 11. After the secondary transfer of the toner images onto the sheet, the cleaning device 18 removes toner remaining on the intermediate transfer belt 11.

The sheet subjected to the secondary transfer of the toner images is transported to the fixing device 20. The fixing device 20 heats and presses the sheet, thereby fixing the toner images on the sheet. The fixing device 20 will be described in detail later.

The ejection roller pair 21 ejects the sheet transported through the fixing device 20 onto the output tray 23. In this manner, printed sheets are deposited on the output tray 23.

The control unit 100 is, for example, a CPU, and is adapted to control the operation of the image forming apparatus 1.

Configuration of Fixing Device

Figure 2:
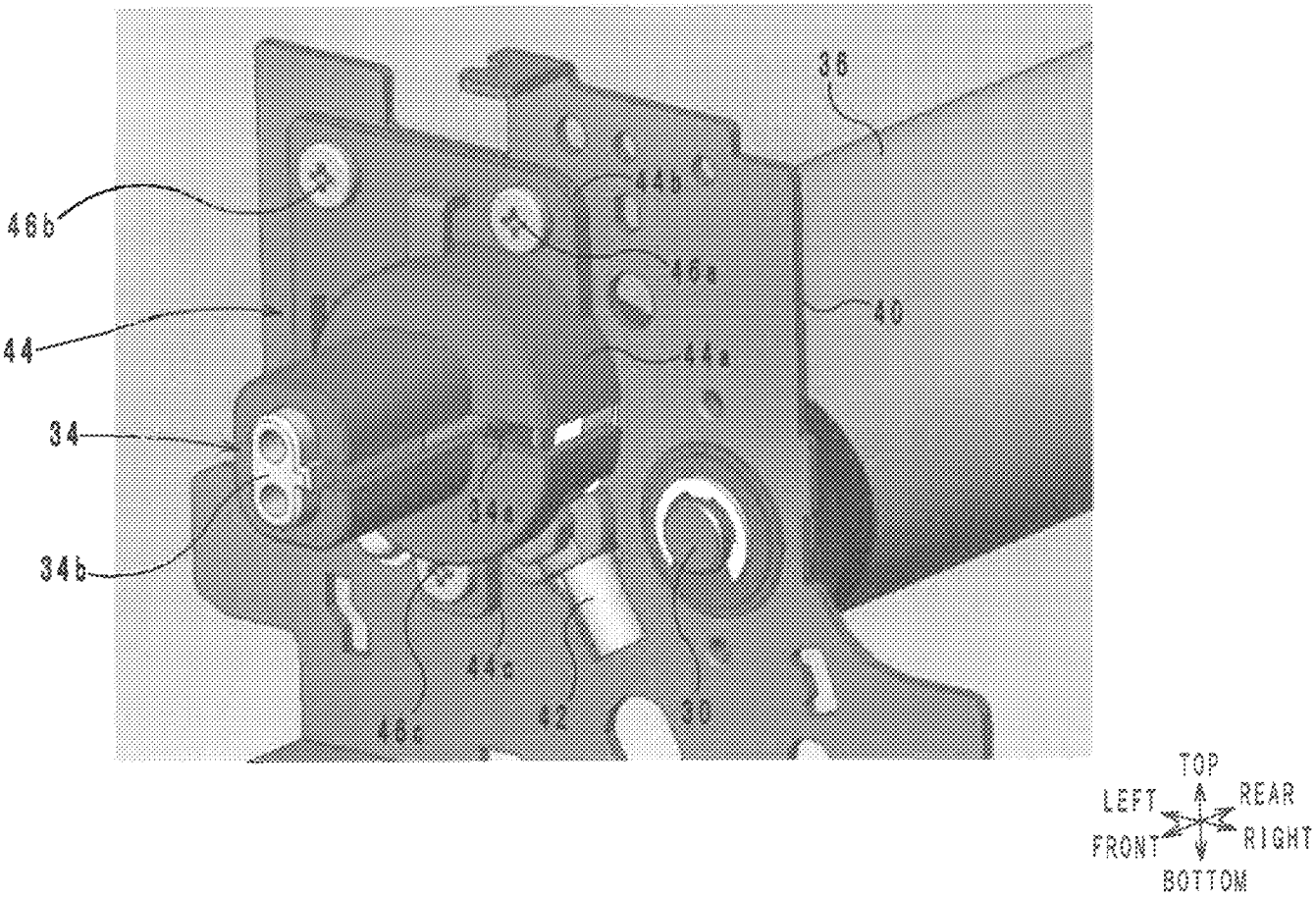
FIG. 2 is an oblique view illustrating a front end of a fixing device 20 and its vicinity.
Figure 3:
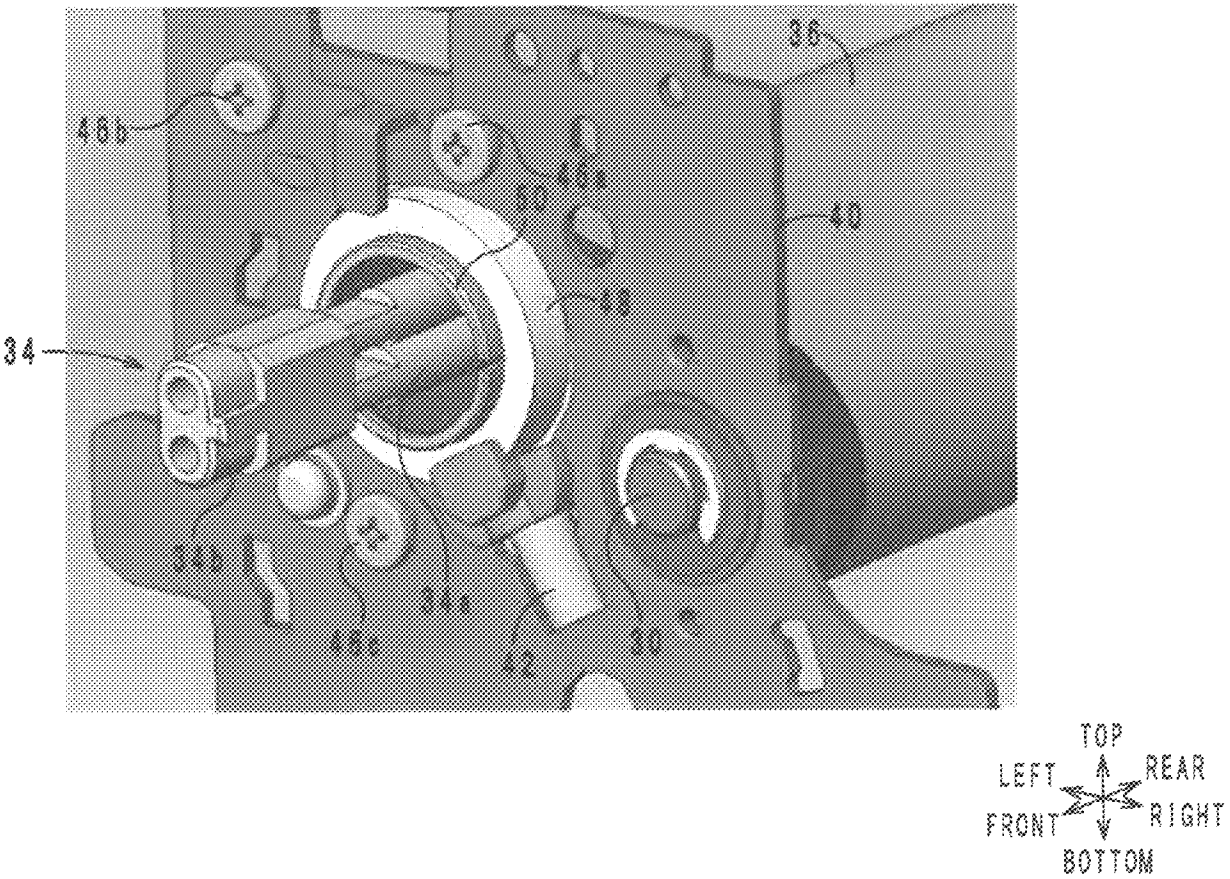
FIG. 3 is an oblique view illustrating the front end of the fixing device 20 and its vicinity where a heater holder 44 is detached.
Figure 4:
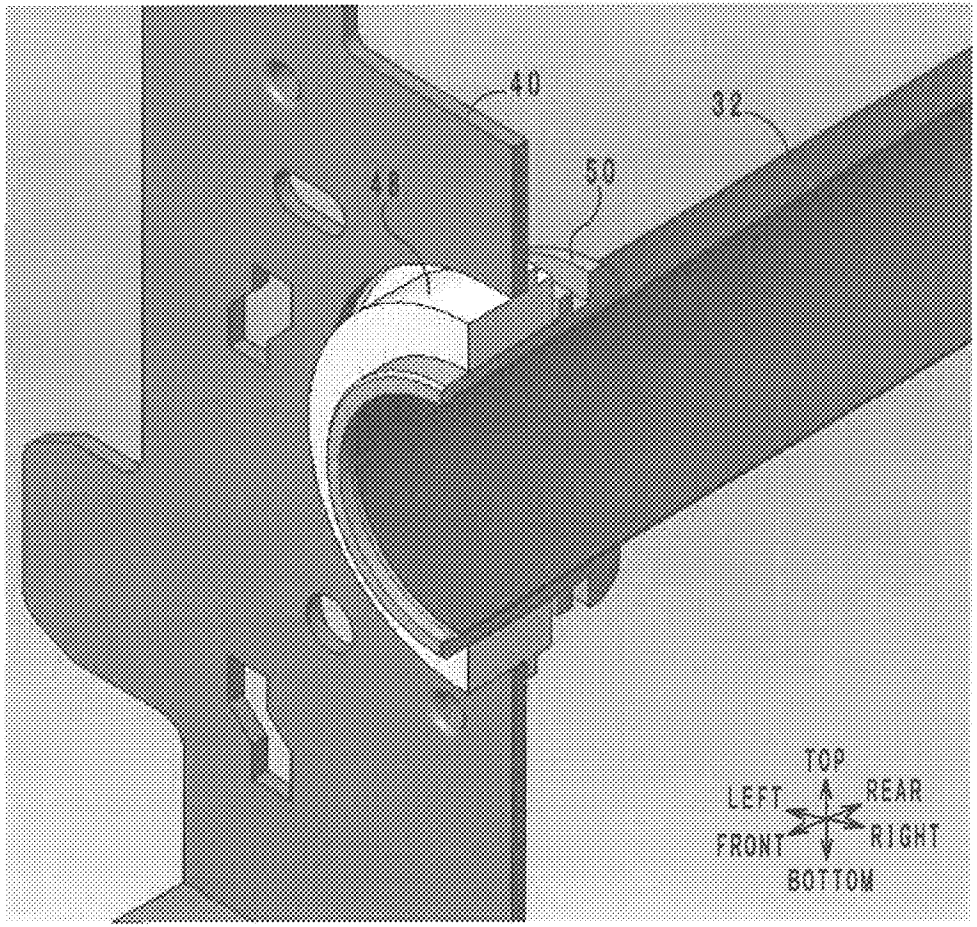
FIG. 4 is an oblique view illustrating a cross-sectional structure including a heating roller 32, a side plate 40, a bearing 48, and an insulating cap 50.
Figure 5:
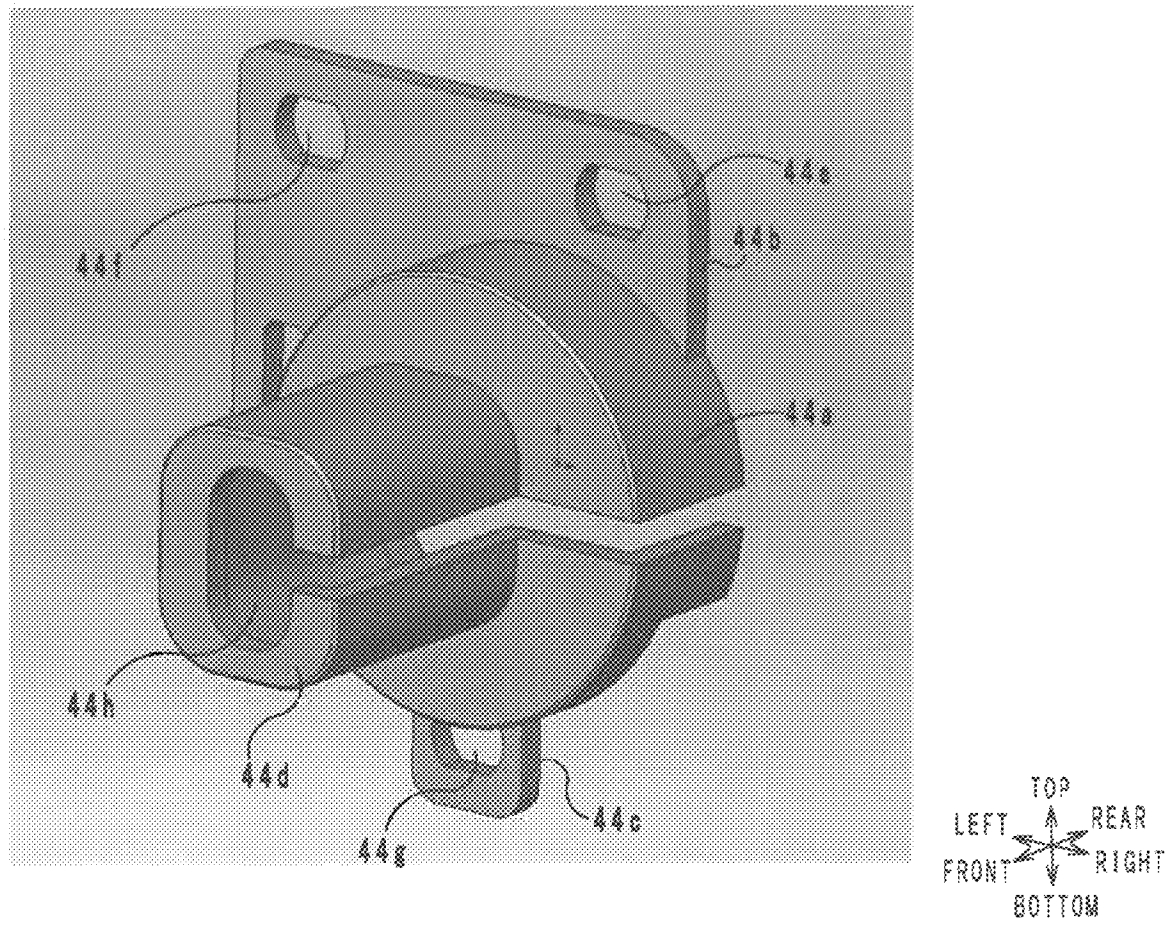
FIG. 5 is an oblique view of the heater holder 44.
Figure 6:
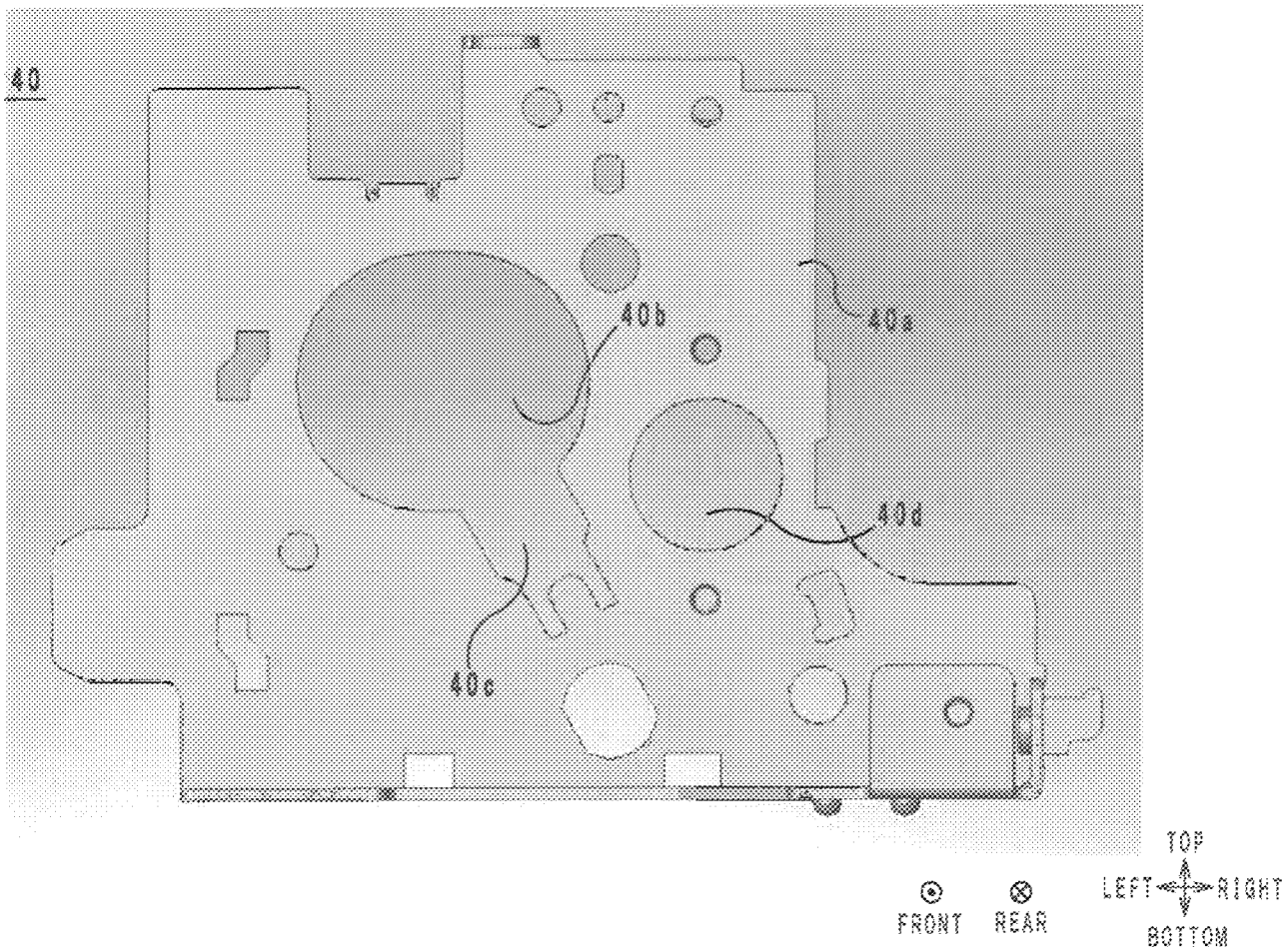
FIG. 6 is a plan view of the side plate 40.

The configuration of the fixing device 20 will be described below with reference to the drawings. FIG. 2 is an oblique view illustrating a front end of the fixing device 20 and its vicinity. FIG. 3 is an oblique view illustrating the front end of the fixing device 20 and its vicinity where a heater holder 44 is detached. FIG. 4 is an oblique view illustrating a cross-sectional structure including a heating roller 32, a side plate 40, a bearing 48, and an insulating cap 50. FIG. 5 is an oblique view of the heater holder 44. FIG. 6 is a plan view of the side plate 40.

The fixing device 20 has the same structure at both the front and back ends. Therefore, only the front-end structure of the fixing device 20 will be described, and any description of the back-end structure will be omitted. The fixing device 20 includes a fixing roller 30, a heating roller 32, a halogen heater 34, a fixing belt 36, a pressure roller 38, the side plate 40, a pressure section 42, the heater holder 44, shoulder screws 46*a* to 46*c*, the bearing 48, and the insulating cap 50, as shown in FIGS. 1 through 3.

The fixing roller 30 is a cylindrical member extending in the front-back direction. The fixing roller 30 is rotatable about a central axis thereof. The fixing roller 30 is not a drive roller to be rotated by a drive source such as a motor, but a driven roller to be rotated by receiving an external force. The fixing roller 30 is formed, for example, by wrapping a silicone rubber layer having a thickness of 2 millimeters [mm] and a silicone sponge layer having a thickness of 2 mm in this order, from bottom to top, around a core, which is a columnar metallic bar (SUM24) having a diameter of 25 mm. Providing the silicone rubber layer and the silicone sponge layer imparts elasticity to the surface of the fixing roller 30.

The heating roller 32 is a cylindrical member extending in the front-back direction. The heating roller 32 is rotatable about a central axis thereof. The heating roller 32 is not a drive roller to be rotated by a drive source such as a motor, but a driven roller to be rotated by receiving an external force. The heating roller 32 is a cylindrical metallic tube, such as a carbon steel tube for machine structural purposes (STKM), which has a diameter of 18 mm. The heating roller 32 has a thickness of 0.3 mm, and has an inner circumferential surface painted in black. Moreover, the surface of the heating roller 32 is coated with perfluoroalkoxy (PFA) resin.

The fixing belt 36 is stretched between the fixing roller 30 and the heating roller 32, and has an annular shape when viewed in a front view. The fixing belt 36 is caused to rotate counterclockwise, when viewed in a front view, by the rotation of the fixing roller 30 and the heating roller 32. The fixing belt 36 is formed, for example, by stacking a silicone rubber layer having a thickness of 100 μm and a PFA resin layer having a thickness of 12 micrometers [μm] in this order, from bottom to top, on a base material made of polyimide and having a thickness of 60 μm. Moreover, the fixing belt 36 is sized so as to rotate in a circle having a diameter of 40 mm.

The halogen heater 34 is a heating section provided in the heating roller 32 and extending in the front-back direction. The halogen heater 34 includes a main body 34*a* and a base 34*b*. The base 34*b* is provided at a front end of the main body 34*a* and connected to a base of a power source (not shown). The main body 34*a* is a heat generator extending in the front-back direction within the heating roller 32 and heating the heating roller 32 by generating heat using power supplied via the base 34*b*. Accordingly, the fixing belt 36 is heated by the heating roller 32 at the portion that is in contact with the heating roller 32. The halogen heater 34 consumes 1200 W of power, and is capable of essentially uniformly heating a 300 mm-wide area through which the sheet passes.

The pressure roller 38 is a columnar member extending in the front-back direction. The pressure roller 38 is rotatable about a central axis thereof. The pressure roller 38 is in contact with the fixing belt 36 on the fixing roller 30 so as to exert pressure upon a portion of the fixing roller 30 that is covered by the fixing belt 36. Accordingly, there is a nip N formed between the fixing belt 36 and the pressure roller 38. The nip N is an area through which a sheet with toner images formed thereon passes. When passing through the nip N, the toner images are situated on the (left) side of the sheet that faces toward the fixing roller 30. The dimension of the nip N in the direction in which the sheet is transported is 8 mm. The speed at which the sheet passes through the nip N is 210 mm per second.

Further, the pressure roller 38 is a drive roller to be rotated clockwise, when viewed in a front view, by a drive source such as a motor. The pressure roller 38 exerts pressure upon the fixing roller 30, as described earlier. Accordingly, in the case where the pressure roller 38 is rotated clockwise when viewed in a front view, the fixing belt 36 and the fixing roller 30 are rotated counterclockwise by means of friction. Moreover, the heating roller 32 is rotated counterclockwise by the fixing belt 36.

Further, the pressure roller 38 is formed, for example, by wrapping a silicone rubber layer having a thickness of 4 mm and a PFA resin layer having a thickness of 30 μm in this order, from bottom to top, around a core, which is a columnar metallic bar (STKM) having a diameter of 27 mm. Providing the silicone rubber layer imparts elasticity to the surface of the pressure roller 38. Moreover, the pressure roller 38 exerts pressure upon the fixing roller 30 with a force (nip load) of 400 newtons [N].

The side plate 40 supports the fixing roller 30 and the heating roller 32 in such a manner that the fixing roller 30 does not move along a predetermined plane perpendicular to the front-back direction, but the heating roller 32 is movable with respect to the fixing roller 30 along the predetermined plane perpendicular to the front-back direction. More specifically, the side plate 40 includes a main part 40*a* made from a metal plate and disposed vertically to the front-back direction, as shown in FIG. 6. The main part 40*a* has an elliptical hole 40*b*, an attachment hole 40*c*, and a circular hole 40*d*. The elliptical hole 40*b* is a hole for supporting the heating roller 32, and stretches in the right-left direction. More specifically, the elliptical hole 40*b* has a shape of two semicircles being connected by two straight lines extending in the right-left direction. The attachment hole 40*c* is a hole for attaching the pressure section 42 to be described later, and is provided below the elliptical hole 40*b* and oriented diagonally downward to the right. The circular hole 40*d* is a hole for supporting the fixing roller 30, and is provided to the right of the elliptical hole 40*b*.

The front end of the fixing roller 30 is inserted in the circular hole 40*d*. Accordingly, the fixing roller 30 is rotatably supported by the side plate 40. Note that to allow the fixing roller 30 to rotate smoothly, the fixing roller 30 may have a bearing or suchlike provided at the front end. The fixing roller 30 is not movable with respect to the side plate 40 either in the top-bottom direction or in the right-left direction.

The insulating cap 50 is a resin member attached at the front end of the heating roller 32, as shown in FIGS. 3 and 4, and inhibits heat transfer from the heating roller 32 to the bearing 48 to be described later. More specifically, the insulating cap 50 has a cylindrical shape extending in the front-back direction. The insulating cap 50 has an inner diameter approximately equal to or slightly greater than an outer diameter of the heating roller 32. The front end of the heating roller 32 is inserted in the insulating cap 50.

The bearing 48 is intended for the heating roller 32, and has an annular shape when viewed in a front view. The bearing 48 is disposed in the elliptical hole 40*b* so as to be positioned between the heating roller 32 and the side plate 40 and movable in the right-left direction together with the heating roller 32. More specifically, the bearing 48 has an inner diameter slightly greater than an outer diameter of the insulating cap 50. Furthermore, the insulating cap 50 is inserted in the bearing 48. Accordingly, the heating roller 32 and the insulating cap 50 are movable together with respect to the bearing 48. Moreover, the bearing 48 has an outer diameter approximately equal to the diameter of the semicircular portion of the elliptical hole 40*b*. In addition, the bearing 48 is inserted in the elliptical hole 40*b*. Accordingly, the bearing 48 is movable in the elliptical hole 40*b* in the right-left direction. That is, the heating roller 32 is movable along the elliptical hole 40*b* in the right-left direction.

The pressure section 42 exerts a force upon the heating roller 32 in a direction pushing the heating roller 32 away from the fixing roller 30. More specifically, the attachment hole 40*c* stretches to the lower right from the elliptical hole 40*b*. The pressure section 42 is a compression spring fitted in the attachment hole 40*c*. The pressure section 42 contacts the bearing 48 at the top end and also contacts a lower right end of the attachment hole 40*c* at the bottom end. Accordingly, the pressure section 42 pushes the bearing 48 toward the upper left. However, the moving direction of the bearing 48 is restricted to the right-left direction within the elliptical hole 40*b*. Therefore, the bearing 48 (i.e., the heating roller 32) receives a force from the pressure section 42 which pushes the bearing 48 away from the fixing roller 30 leftward. As a result, a tension (e.g., 50 N) appropriate for the fixing belt 36 is generated.

The heater holder 44 supports the halogen heater 34 in such a manner as to allow the halogen heater 34 to move together with the heating roller 32. More specifically, the heater holder 44 includes a bearing support 44*a*, flanges 44*b* and 44*c*, and a heater support 44*d*, as shown in FIG. 5. The bearing support 44*a* has a cylindrical shape extending in the front-back direction. The bearing support 44*a* has an inner diameter approximately equal to the outer diameter of the bearing 48. The heater holder 44 supports the bearing 48 by the bearing support 44*a* covering the outer circumferential surface of the bearing 48. That is, the heater holder 44 supports the heating roller 32 by means of the bearing 48.

The heater support 44*d* has a tube-like shape protruding forward from the front of the bearing support 44*a*. The heater support 44*d* includes an elliptical hole 44*h* provided at the front end so as to stretch in the top-bottom direction. The heater holder 44 supports the halogen heater 34 with the base 34*b* being accommodated in the heater support 44*d*. Moreover, the base 34*b* is exposed outside at the front end from the heater holder 44 through the elliptical hole 44*h*. In this manner, the halogen heater 34 is fixed to the heating roller 32.

The flange 44*b* is a flat plate protruding upward from the bearing support 44*a* and being vertical to the front-back direction. The flange 44*b* is provided with elliptical holes 44*e* and 44*f* stretching in the right-left direction. The flange 44*c* is a flat plate protruding downward from the bearing support 44*a* and being vertical to the front-back direction. The flange 44*c* is provided with an elliptical hole 44*g* stretching in the right-left direction.

The shoulder screws 46*a* to 46*c* are respectively inserted in the elliptical holes 44*e* to 44*g*. Moreover, the shoulder screws 46*a* to 46*c* are inserted at their tips in holes (not shown) of the side plate 40 and fixed to the side plate 40. In this manner, the heater holder 44 is configured so as to be movable with respect to the side plate 40 in the right-left direction and also resistant to being detached from the side plate 40 and the bearing 48. Therefore, the heating roller 32 and the halogen heater 34 are supported by the heater holder 44 and thereby movable together with respect to the fixing roller 30 in the right-left direction.

Effects

Figure 7:
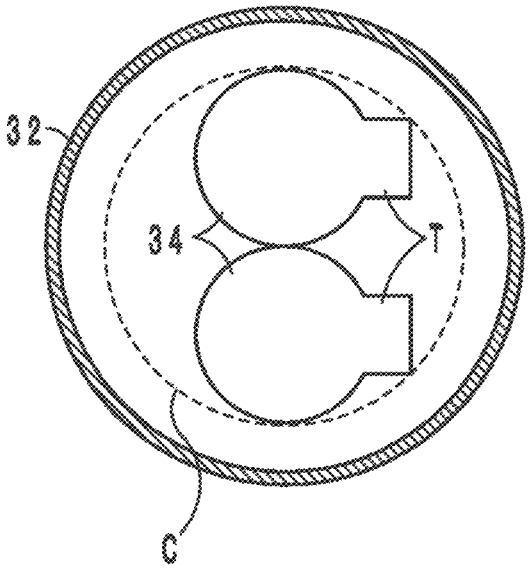
FIG. 7 is a cross-sectional structure diagram of the heating roller 32 of the fixing device 20.

The fixing device 20 according to the present embodiment makes it possible to reduce the diameter of the heating roller 32. FIG. 7 is a cross-sectional structure diagram of the heating roller 32 of the fixing device 20.

The heating roller 32 has an inner diameter R1 designed to satisfy equation (1) below in order not to bring the inner circumferential surface of the heating roller 32 into contact with the halogen heater 34 when the heating roller 32 moves in the right-left direction.

$$R1=R2+d+W \quad (1)$$

R2: Diameter of a circumscribed circle C of the halogen heater 34 d: Component tolerance

W: Moving distance of the heating roller 32 relative to the halogen heater 34

The diameter R2 of the circumscribed circle C of the halogen heater 34 is determined considering the height of a tip T of the halogen heater 34. The tip T is a protrusion formed on the halogen heater 34 during production. The halogen heater 34 includes two heating members whose heat generation areas are different in length. The reason for this is that the two heating members are used for different sheet sizes. Moreover, each of the two heating members has a diameter of 6 mm.

In general fixing devices, the halogen heater is not movable together with the heating roller. The moving distance W of the heating roller 32 relative to the halogen heater 34 is 2 mm. In this case, the inner and outer diameters of the heating roller 32 are respectively 19.4 mm and 20 mm. Note that other dimensions for such a general fixing device are as shown below.

R2: 14.4 mm d: 3 mm

W: 2 mm t (the thickness of the heating roller 32): 0.3 mm

On the other hand, in the fixing device 20, the heater holder 44 supports the halogen heater 34 in such a manner as to allow the halogen heater 34 to move together with the heating roller 32. Accordingly, the moving distance W of the heating roller 32 relative to the halogen heater 34 is 0 mm. As a result, in the fixing device 20, the inner diameter R1 of the heating roller 32 can be reduced by 2 mm compared to general fixing devices. Therefore, the inner and outer diameters of the heating roller 32 are respectively 17.4 mm and 18 mm. Note that other dimensions for the fixing device 20 are as shown below.

R2: 14.4 mm d: 3 mm

W: 0 mm t: 0.3 mm

In the case where the diameter of the heating roller 32 is reduced as described above, the heating roller 32 has a lower heat capacity. Consequently, it only requires lower energy to raise the temperature of the heating roller 32, making the fixing device 20 energy saving.

Furthermore, the fixing device 20 allows the heating roller 32 to be readily positioned parallel to the fixing roller 30. For example, the fixing roller 30 might deviate slightly from perpendicularity toward the side plate 40 due to production variation or suchlike. Therefore, the heating roller 32 is inserted at both ends in the elliptical holes 40*b* provided in the side plates 40. As a result, the ends of the heating roller 32 are independently movable in the elliptical holes 40*b* in the right-left direction. Therefore, when the pressure section 42 applies force to the ends of the heating roller 32, the fixing belt 36 is tensed, so that the heating roller 32 and the fixing roller 30 are kept parallel to each other. By keeping the fixing roller 30 and the heating roller 32 parallel to each other, it is rendered possible to inhibit the fixing belt 36 from meandering toward the front or back side of the apparatus while the fixing belt 36 is rotating. By inhibiting such meandering of the fixing belt 36, it is rendered possible to inhibit the fixing belt 36 from being damaged.

Furthermore, the insulating caps 50 contact the sides of the fixing belt 36 on both the front and back sides of the apparatus. Accordingly, movement of the fixing belt 36 in the front-back direction is restricted, so that the fixing belt 36 is inhibited from meandering toward the front or back side of the apparatus.

Furthermore, the fixing roller 30 and the heating roller 32 are supported by the pair of side plates 40. This allows the fixing roller 30 and the heating roller 32 to be equal in length. Therefore, it is unnecessary to render one of the fixing roller 30 and the heating roller 32 longer than the other. Thus, the heat capacity of the fixing roller 30 or the heating roller 32 can be reduced, making the fixing device 20 energy saving.

Furthermore, the thickness of the fixing belt 36 used is 0.2 mm, which is extremely thin, and therefore, the temperature of the fixing belt 36 can be raised to a point that allows fusing, in a very short period of time. This renders it possible to shorten the period of time for which the fixing belt 36 is heated, and thereby shorten the period of time in which the halogen heater 34 is kept on. Thus, the fixing device 20 can be made energy saving.

Furthermore, in the fixing device 20, the fixing belt 36 is kept stretched between the fixing roller 30 and the heating roller 32 by the pressure section 42 pushing the heating roller 32. Accordingly, the area of contact between the fixing belt 36 and the heating roller 32 increases, so that heat efficiently transfers from the heating roller 32 to the fixing belt 36.

In the present embodiment, the reason that the heating roller 32 should move has been described as being to prevent the fixing belt 36 from slackening, thereby causing heat from the heating roller 32 to be transferred to the fixing belt 36 efficiently. However, there may be another reason that the heating roller 32 should move. More specifically, in the case where a sheet of paper with no toner images printed thereon passes through the fixing device 20 or in the case where toner images are fixed on relatively thick paper such as an envelope, the pressure roller 38 is simply required to be in contact with the fixing belt 36 with a relatively low pressure. Such a state will be referred to below as "low-pressure contact state (with a nip load of 50 N)". On the other hand, in the case where toner images are fixed on a normal sheet of paper, the pressure roller 38 is simply required to be in contact with the fixing belt 36 with a relatively high pressure. Such a state will be referred to below as "high-pressure contact state (with a nip load of 400 N)". In this manner, the fixing device 20 is configured to be switched between low-pressure contact state and high-pressure contact state. Low-pressure contact state and high-pressure contact state differ in terms of the force applied to the fixing roller 30 and the fixing belt 36, and therefore, the tension generated on the fixing belt 36 also varies. That is, by switching between low-pressure contact state and high-pressure contact state, the fixing belt 36 is stretched or slackened. Therefore, the heating roller 32 is rendered movable with respect to the fixing roller 30, thereby causing the fixing belt 36 to be stretched between the fixing roller 30 and the heating roller 32 with an appropriate tension.

The fixing device 20 is in low-pressure contact state except during printing of toner images. This is because if the fixing device 20 rests in high-pressure contact state for a long period of time, rubber of the fixing roller 30 and the pressure roller 38 might be deformed.

Furthermore, in the fixing device 20, the heating roller 32 moves, but the fixing roller 30 does not move. This inhibits deterioration of toner image quality, as will be described below. More specifically, if the fixing roller, which creates a nip, moves, the transportation path between the fixing roller and the pressure roller might become unstable, resulting in deterioration of toner image quality. Therefore, the fixing device 20 is configured in such a manner that the heating roller 32 moves, but the fixing roller 30 does not move. Thus, the transportation path is kept stable, and toner image quality is inhibited from deteriorating.

For the following reason, it is preferable that the heater holder 44 be provided with holes from which heat generated by the halogen heater 34 is released to the outside of the heating roller 32. Specifically, the heater holder 44 covers the bearing 48. Accordingly, the end of the heating roller 32 is capped by the heater holder 44. In this structure, heat inside the heating roller 32 is less likely to be released to the outside, so that the temperature of the halogen heater 34 rises at its joining plate. The joining plate of the halogen heater 34 is a metal plate provided in the base 34*b* in order to connect a lead wire in the base 34*b* and a tungsten wire being led from the main body 34*a*. The joining plate uses, for example, molybdenum foil. Accordingly, when the temperature of the joining plate rises, the molybdenum foil is oxidized, resulting in deterioration of the halogen heater 34.

Therefore, the heater holder 44 is provided with the holes. This allows heat inside the heating roller 32 to be released to the outside. As a result, the temperature of the joining plate is inhibited from rising, so that the heater holder 44 is prevented from deteriorating.

Furthermore, by providing the heater holder 44 with the holes, the heat capacity of the heater holder 44 is reduced. As a result, the thermal energy required to raise the temperature of the heating roller 32 is reduced, making the fixing device 20 energy saving.

Furthermore, it is preferable that the base 34*b* be held in the heater holder 44 outside the heating roller 32. This inhibits an increase in the temperature of the joining plate inside the base 34*b*.

First Modification

Figure 8:
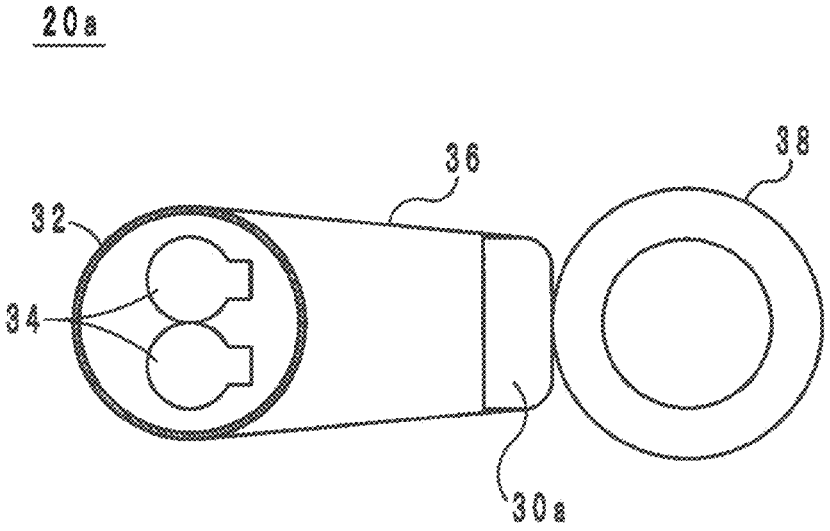
FIG. 8 is a configuration diagram of a fixing device 20*a* according to a first modification.

A fixing device 20*a* according to a first modification will be described below with reference to FIG. 8. FIG. 8 is a configuration diagram of the fixing device 20*a* according to the first modification.

The fixing device 20*a* differs from the fixing device 20 in that a fusing pad 30*a* is used in place of the fixing roller 30. The fixing device 20*a* thus configured can also achieve the same effects as those achieved by the fixing device 20.

Second Modification

Figure 9:
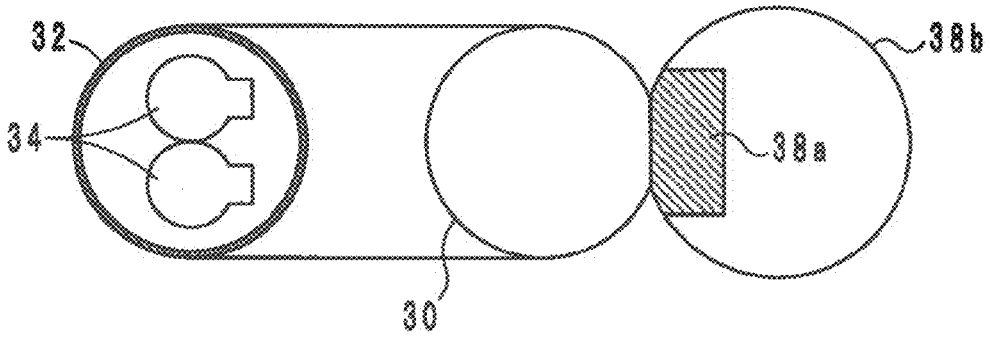
FIG. 9 is a configuration diagram of a fixing device 20*b* according to a second modification.

A fixing device 20*b* according to a second modification will be described below with reference to FIG. 9. FIG. 9 is a configuration diagram of the fixing device 20*b* according to the second modification.

The fixing device 20*b* differs from the fixing device 20 in that a pressure pad 38*a* and a pressure belt 38*b* are used in place of the pressure roller 38. The pressure belt 38*b* is a belt forming an annular shape when viewed in a front view. The pressure pad 38*a* causes the pressure belt 38*b* to contact the fixing roller 30 under pressure by pushing from inside the pressure belt 38*b*. The fixing device 20*b* thus configured can also achieve the same effects as those achieved by the fixing device 20.

Third Modification

Figure 10:
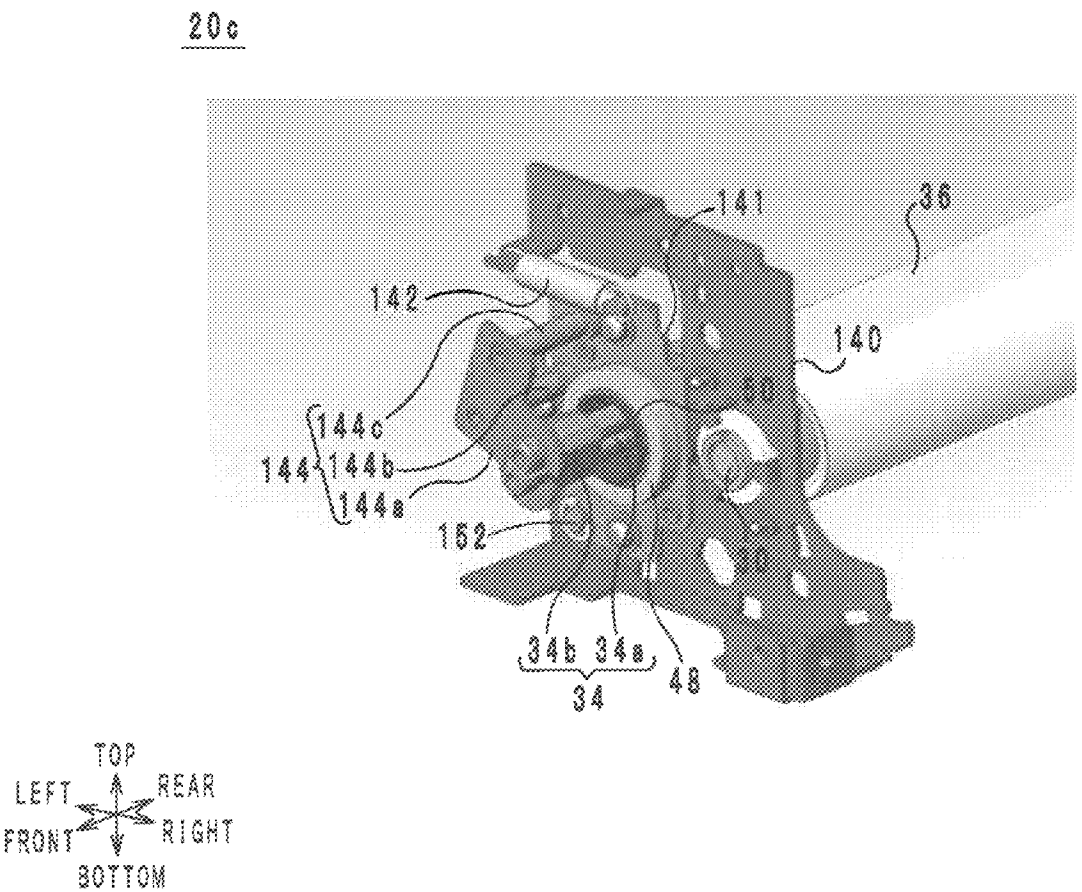
FIG. 10 is an oblique view of a fixing device 20*c* according to a third modification where a front end of the fixing device 20*c* and its vicinity are shown.

A fixing device 20*c* according to a third modification will be described below with reference to FIG. 10. FIG. 10 is an oblique view of the fixing device 20*c* according to the third modification where a front end of the fixing device 20*c* and its vicinity are shown.

The fixing device 20*c* differs from the fixing device 20 in that side plates 140 and 141 are provided in place of the side plate 40. The fixing device 20*c* will be described below mainly focusing on the difference.

The fixing device 20*c* has the same configuration at its front and back ends. Therefore, only the front-end structure of the fixing device 20*c* will be described below, and any description of the back-end structure will be omitted. As shown in FIG. 10, the fixing device 20*c* includes the fixing roller 30, the heating roller 32 (not shown in FIG. 10), the halogen heater 34, the fixing belt 36, the pressure roller 38, the bearing 48, the insulating cap 50, the side plates 140 and 141, a pressure section 142, a heater holder 144, and a pin 152.

The fixing roller 30, the heating roller 32, the halogen heater 34, the fixing belt 36, the pressure roller 38, the bearing 48, and the insulating cap 50 of the fixing device 20*c* are the same as those of the fixing device 20, and therefore, any descriptions thereof will be omitted.

The side plate 140 supports the fixing roller 30. However, the fixing roller 30 is not movable with respect to the side plate 140 either in the top-bottom direction or in the right-left direction.

The side plate 141 supports the heating roller 32 and is positioned slightly forward from the side plate 140. The heating roller 32 is not movable with respect to the side plate 141 either in the top-bottom direction or in the right-left direction. Accordingly, the bearing 48 is fitted in a circular hole, rather than in an elliptical hole.

Furthermore, the side plate 141 is rotatable with respect to the side plate 140 about an axis extending in the front-back direction. More specifically, the side plate 141 is attached to the side plate 140 by the pin 152 having an axis extending in the front-back direction, such that the side plate 141, when viewed in a front view, is rotatable about the pin 152 with respect to the side plate 140. This allows the heating roller 32 to circle around the pin 152 when viewed in a front view. Thus, the heating roller 32 is movable with respect to the fixing roller 30 in a plane vertical to the front-back direction.

The pressure section 142 exerts a force upon the heating roller 32 in such a direction that the heating roller 32 moves away from the fixing roller 30. In the present embodiment, the pressure section 142 is a tension spring which connects the side plate 140 and the side plate 141, and generates a force that causes the side plate 141 to rotate counterclockwise with respect to the side plate 140.

The heater holder 144 is a member for coupling the halogen heater 34 and the side plate 141, and includes a holding plate 144*a* and shafts 144*b* and 144*c*. The holding plate 144*a* is a plate-like member for holding the base 34*b* of the halogen heater 34. The shafts 144*b* and 144*c* are bar-like members extending backward from the holding plate 144*a*. The shafts 144*b* and 144*c* are fixed at their respective back ends to the side plate 141. Thus, the heating roller 32 and the halogen heater 34 are supported by the heater holder 144 so as to be movable together with respect to the fixing roller 30.

The fixing device 20*c* thus configured can also achieve the same effects as those achieved by the fixing device 20.

In the fixing device 20*c*, the end of the heating roller 32 is not capped by the heater holder 144. This results in improved heat dissipation inside the heating roller 32.

In the fixing device 20*c*, the bearing 48 is not supported by the heater holder 144. Accordingly, the bearing 48 does not have to be thick enough to contact the heater holder 144. Therefore, as the bearing 48, an off-the-shelf bearing can be used. Thus, the design of the fixing device 20*c* is more flexible.

From the viewpoint of keeping the fixing roller 30 and the heating roller 32 parallel to each other, the fixing device 20 is superior to the fixing device 20*c*. More specifically, in the fixing device 20*c*, the fixing roller 30 and the heating roller 32 are supported by two pairs of side plates 140 and 141. The side plate 141 is supported on the side plate 140 by the pin 152. Accordingly, it is necessary to keep the central axes of the fixing roller 30, the heating roller 32, and the pin 152 parallel to one another. On the other hand, in the fixing device 20, the fixing roller 30 and the heating roller 32 are supported by one pair of side plates 40. Accordingly, it is simply necessary to keep the central axes of the fixing roller 30 and the heating roller 32 parallel to each other. Therefore, from the viewpoint of keeping the fixing roller 30 and the heating roller 32 parallel to each other, the fixing device 20 is superior to the fixing device 20*c*.

Other Embodiments

The present invention is not limited to the fixing devices 20 and 20*a* to 20*c*, and any changes can be made without departing from the spirit and scope of the invention.

The fixing devices 20 and 20*a* to 20*c* may be combined arbitrarily.

In the fixing device 20, the elliptical holes 44*e* to 44*g* are simply required to stretch in the right-left direction. Therefore, the direction in which the elliptical holes 44*e* to 44*g* stretch may slightly deviate from the right-left direction.

The heating roller 32 is simply required to be movable with respect to the fixing roller 30 along a predetermined plane perpendicular to the front-back direction. However, the distance between the fixing roller 30 and the heating roller 32 needs to change in accordance with the movement of the heating roller 32. Therefore, cases where the heating roller 32 circles around the fixing roller 30 when viewed in a front view are invalid.

Although the present invention has been described in connection with the preferred embodiment above, it is to be noted that various changes and modifications are possible to those who are skilled in the art. Such changes and modifications are to be understood as being within the scope of the invention.

What is claimed is:

1. A fixing device comprising:

a fixing member extending in a first predetermined direction;

a heating roller extending in the first predetermined direction;

a fixing belt stretched between the fixing member and the heating roller and being annular when viewed in a plan view in the first predetermined direction;

a heating section heating the heating roller and being provided in the heating roller;

a first support section supporting the heating roller in such a manner that the heating roller is movable with respect to the fixing member along a predetermined plane perpendicular to the first predetermined direction;

a pressure section exerting a force upon the heating roller in such a direction that the heating roller moves away from the fixing member; and a second support section supporting the heating section in such a manner that the heating section is movable together with the heating roller, wherein the second support section is provided with a hole for releasing heat generated by the heating section to the outside of the heating roller.

2. The fixing device according to claim 1, wherein, the first support section is provided with an elliptical hole stretching in a second predetermined direction perpendicular to the first predetermined direction, and the heating roller is inserted in the elliptical hole so as to be movable in the second predetermined direction along the elliptical hole.

3. The fixing device according to claim 2, further comprising a bearing movable together with the heating roller in the second predetermined direction, the bearing being provided in the elliptical hole so as to be positioned between the heating roller and the first support section, wherein, the second support section supports the bearing in such a manner that the heating section is movable together with the heating roller in the second predetermined direction.

4. The fixing device according to claim 1, wherein the first support section, in addition to supporting the heating roller, supports the fixing member in such a manner that the fixing member is not movable along the predetermined plane.

5. The fixing device according to claim 1, wherein, the first support section includes a third support section supporting the fixing member and a fourth support section supporting the heating roller, the fourth support section is rotatable with respect to the third support section about an axis extending in the first predetermined direction, and the second support section couples the heating section and the fourth support section.

6. The fixing device according to claim 1, further comprising a pressure roller being in contact with the fixing belt on the fixing member so as to exert pressure upon a portion of the fixing roller that is covered by the fixing belt.

* * * * *